US008256350B2

(12) United States Patent
Haskins

(10) Patent No.: US 8,256,350 B2
(45) Date of Patent: Sep. 4, 2012

(54) INSENSITIVE MUNITION

(75) Inventor: Peter J Haskins, Sevenoaks (GB)

(73) Assignee: Qinetiq Limited, London (GB)

( * ) Notice: Subject to any disclaimer, the term of this patent is extended or adjusted under 35 U.S.C. 154(b) by 0 days.

(21) Appl. No.: 12/726,575

(22) Filed: Mar. 18, 2010

(65) Prior Publication Data

US 2010/0236443 A1 Sep. 23, 2010

(30) Foreign Application Priority Data

Mar. 23, 2009 (GB) ..... 0904929.7

(51) Int. Cl.
*F42B 12/20* (2006.01)

(52) U.S. Cl. ..... 102/478; 102/481

(58) Field of Classification Search ..... 102/478, 102/479, 473, 481, 275.11
See application file for complete search history.

(56) References Cited

U.S. PATENT DOCUMENTS

| | | | | |
|---|---|---|---|---|
| 3,757,694 | A | 9/1973 | Talley et al. | |
| 3,960,085 | A | 6/1976 | Abernathy et al. | |
| 5,267,513 | A | 12/1993 | Guirguis et al. | |
| 7,895,947 | B1 * | 3/2011 | Sutherland et al. | 102/254 |
| 2006/0037509 | A1 * | 2/2006 | Kneisl | 102/355 |
| 2011/0203475 | A1 * | 8/2011 | Thuman | 102/275.11 |

FOREIGN PATENT DOCUMENTS

| | | |
|---|---|---|
| EP | 0 338 874 A1 | 10/1989 |
| EP | 2 133 654 A2 | 12/2009 |
| GB | 2 442 382 | 4/2008 |

OTHER PUBLICATIONS

UK Search Report for GB 0904929.7, dated Jul. 13, 2009.
European Search Report in EP 10 25 0511 mailed Jul. 27, 2011.

* cited by examiner

*Primary Examiner* — James Bergin
(74) *Attorney, Agent, or Firm* — Nixon & Vanderhye P.C.

(57) ABSTRACT

This invention relates to a novel insensitive munition comprising one warhead and also munitions comprising one or more warheads. In particular, the invention lies in the field of insensitive munition warheads. There are further provided methods of preparing the warheads of the invention, methods of controllably detonating the warheads and a kit suitable for preparing such a warhead. The warhead comprises at least two portions of high explosive separated by a non-detonative material, wherein each portion has a cross section below its critical detonation cross section, and wherein the at least two portions are arranged such that the total cross section of the at least two portions exceeds the critical detonation cross section of said high explosive, such that in use only simultaneous detonation of the at least two high explosives causes detonation to occur.

14 Claims, 6 Drawing Sheets

INSENSITIVE MUNITION

This invention relates to warheads, and munitions comprising one or more warheads. In particular, the invention lies in the field of insensitive munition warheads, especially those capable of providing a reduced response to hazard stimuli such as fragment or bullet attack. The warhead will find particular use in increasing the IM compliance of munitions. There are further provided methods of preparing the warheads of the invention, methods of controllably detonating the warheads and a kit suitable for preparing such a warhead.

BACKGROUND OF THE INVENTION

There have been a number of accidents aboard warships that resulted in a large number of casualties and loss of platforms and systems and munitions, which has led to the requirement of providing weapons/munitions that have a reduced response to potential hazard stimuli. The subject of Insensitive Munitions (IM) has become an important one in the design, procurement, storage and deployment of any weapons system that employs propellants or explosives, that is most weapons. There is now a general requirement to design main charges, booster charges, explosive trains, rocket motors and gun propellant charges such that, when exposed to a disruptive threat, they respond as benignly as possible. Therefore, ideally they should give rise to a burning reaction, rather than a high order explosive event or a detonation. In this way it is hoped to avoid the generation of a shockwave or of damaging fragments that would adversely affect other weapons stored in the proximity. By so doing, the hope is that fratricidal events or "chain reactions" can be avoided.

By the term "munition" as used herein is meant any casing that carries a high explosive material in the form of a warhead. The munition may also comprise other energetic materials that are used to deliver said warhead, such as bombs, rockets, or any similar device.

There are many devices that are fitted/incorporated onto munitions to reduce the effects of external hazard events. However, many of these introduce their own drawbacks, such as adding parasitic mass, or even adding additional energetic materials which are designed to react against certain hazard events. It is therefore desirable to provide a means of reducing the likelihood of a detonative event when part of the warhead is subjected to a detonative blast or fragment/bullet attack which would otherwise cause detonation of the whole munition, without reducing the effectiveness and output of the munition when deployed in its normal mode of use.

SUMMARY OF THE INVENTION

According to a first aspect of the invention there is provided a warhead comprising at least two portions of high explosive separated by a non-detonative material, wherein each portion of high explosive has a cross section below its critical detonation cross section, and wherein the at least two portions of high explosive are arranged such that the total cross section of the at least two portions of high explosive exceeds the critical detonation cross section of said high explosive, such that in use only simultaneous detonation of the at least two portions of high explosive causes detonation to occur.

The critical detonation cross section for a high explosive is the minimum cross section of that explosive that can be detonated in a direction normal to the cross section in the absence of any confinement. In other words, it is the minimum physical cross section of a specific explosive that must be present in order to sustain its own detonation wave. Typically, munitions are built with cylindrical charges and so the term critical diameter is routinely used. Clearly, however, any cross section shape of high explosive may be used, and so there will be a minimum i.e. critical detonation cross section that is required in order for a particular explosive to sustain its own detonation wave. The effective critical detonation cross section is reduced if the explosive is heavily confined, so this will need to be taken into account when the charge is located inside a munition. The reduction in effective critical detonation cross section would be readily calculated by those skilled in the art. The measurement of the critical detonation cross section of any given high explosive may be determined by routine experimentation, to provide a precise and reproducible value, in a given batch of explosive.

The warhead of the current invention has the advantage that it may only sustain detonation when substantially all or more preferably all, of the separate portions of high explosive are initiated simultaneously. When the at least two portions of high explosive material are instead subjected to a single stimuli that does not simultaneously act upon the at least two portions of high explosives or spatially or temporally separated multiple stimuli, detonation of the warhead should not occur, because each portion on its own is not capable of sustaining detonation. Consequently, the worst hazard response possible is likely to be merely some form of burning or deflagration reaction, i.e. a lower order reaction.

There is no limit to the number of portions of high explosive in theory, but in practise too many portions will make fabrication of the warhead difficult and thus excessive numbers of portions of high explosive are undesirable.

Therefore in a highly preferred arrangement there are at least 3 portions of high explosive, more preferably at least 4, yet more preferably at least 5 portions of high explosive. Preferably there are between 2 and 30 portions of high explosive, more preferably 5 to 20, each of which is below its critical detonation cross section.

High explosives which possess a critical detonation cross section that is only marginally below said critical dimension may start to detonate, but will fail to sustain detonation along the entire length of the charge. Ideally, the respective critical detonation cross sections of (n) number of portions of high explosive are selected so as to ensure that there is substantially no detonation along the length of the portion of high explosive when (n−1), (n−2), or fewer, number of portions of high explosive are subjected to a detonative impulse. It is desirable that any detonation that does start to occur in (n−1), (n−2), or fewer number of charges, decays or fails in a short length of the portion of high explosive. However, as the value of n increases it becomes likely that detonation will result if simultaneous initiation of a high percentage of the (n) charges were to occur. This follows since for a given percentage of the number of charges (n) the total surface area initiated will increase with increase in n. However, this remains acceptable behaviour because as the value of n increases, the probability that a particular hazardous event will be capable of simultaneously detonating the required number of portions of explosive material, so as to lead to sustained detonation, will also be reduced.

Preferably, the portions of high explosive are elongate, so as to increase the total explosive mass available in the warhead.

As mentioned above, the portions of high explosive may possess any suitable cross sectioned shape. The shape may be selected to increase the packing density of the separate portions of high explosive, such as, for example, a polygon shaped cross section. Seven hexagonal cross section shaped portions of high explosive, arranged in a close packed arrangement, will form a closer packed arrangement than the corresponding circular cross sectioned portions. Other cross sectioned shapes, with curved or flat edges, may be used to provide alternative close packing arrangements.

Prior art warheads are generally built in a circular fashion to give a generally cylindrical explosive filling. Explosive fillings such as, for example, melt cast or consolidated powders may be prone to cracking at the edges of the filling. Therefore a generally circular shape of explosive filling is preferred as it reduces the number of edges present. In the same way, each portion of high explosive used in the invention may conveniently be substantially cylindrical, and each cylinder is of a diameter which is below its critical detonation diameter. The spaces that are created between the portions of high explosives, especially when cylindrical portions of high explosives are used, these spaces may be filled with the non-detonative material.

The at least two portions of high explosive must be arranged such that the total cross section of the at least two portions of high explosive exceeds the critical detonation cross section of said high explosive. The arrangement may be provided such for example by co-locating separate elongate element along their longest axis or providing a co-axial arrangement.

By the term separated is meant that the individual portions of high explosive material are located apart from each other such that detonation in one of the of portions of high explosive does not readily propagate to the neighbouring portion of high explosive. Preferably the separation is such that portions of high explosive are not in intimate contact, i.e. are not abutting, with neighbouring portions of high explosive. The separation is provided by the non-detonative material as defined herein. The separation may be provided by one or more layers of the non-detonative material, which may cover part, substantially all or the entire surface of the individual portions of high explosives.

The portions of high explosive may be made from any high explosive material. By high explosive is meant a material which is capable of sustaining detonation when it is impacted upon by a detonative impulse. It is not desirable to choose initiatory compounds (such as, for example azides), or compounds that are capable of building up to detonation from a deflagration or burning event.

Typically, the explosive composition will be based upon a standard high (secondary) explosive compound, such as, for example, RDX, HMX, NTO, TATB. Preferably the explosive composition will be a cast cured PBX i.e. a high explosive in a polymer binder, such as, for example RDX/HTPB whose composition will be chosen to give the desired critical detonation cross section. Conveniently the critical detonation cross section may be altered by the addition of desensitising agents, so that the size of each portion of high explosive may be adjusted depending on the size and design of the intended warhead application. The high explosive composition may itself contain blast enhancing materials, such as, for example, reactive metal powders, such as, for example, aluminium.

In one arrangement the high explosive material in the portion of high explosive material may be selected from the same or different high explosive material, provided that the cross sections of different portions of high explosive material do not exceed the critical detonation cross section.

The non-detonative material may be any material that is itself not capable of sustaining detonation; otherwise the portions of high explosive and the non-detonative material would exceed the critical detonation cross section. The non-detonative material may comprise inert materials such as polymers and rubbers, or it may possess high energy materials that enhance the blast, provided such high energy materials are not themselves capable of sustaining detonation. In theory the non-detonative material may be an air gap, but in practise this would give rise to movement of the individual portions of high explosive which may cause breakage. Therefore any air gap must be supported, to prevent movement of the portions of high explosive, as the high explosive material needs to survive transport and handling regimes during its lifetime. Preferably, the non-detonative material comprises a high energy material such as an energetic material (i.e. combustible material), or powdered metal, particularly aluminium in an inert binder, or an energetic polymer binder material. The energetic polymer binder may, for example, be selected from Polyglyn (Glycidyl nitrate polymer), GAP (Glycidyl azide polymer) or Polynimmo (3-nitratomethyl-3-methyloxetane polymer).

There are many known additives for binders and explosive formulations that are used to enhance the output performance of the warhead. Advantageously, the non-detonative material may comprise a high energy material so as to compensate for the reduction in the total volume/mass of high explosive missing i.e. the material that would have occupied the separation between abutting portions of high explosive in the warhead of the munition. The use of aluminium particles to enhance blast is well known and is a highly preferred additive.

In order to provide a further barrier between an incoming fragment, bullet, shockwave or the like and the portions of high explosive, a further portion of the non-detonative material may be enveloped around the outer perimeter of the total cross section of the at least two portions. Thus, the entire outer surface of the at least two portions of high explosive may be covered with the non-detonative material. It may not be desirable to cover the small area on the end surface of the portions of high explosive which has the initiator located thereon, as this may reduce the effectiveness of the detonation of the munition.

By simultaneous is meant substantially simultaneously, such that the detonative shockwave is applied to all of the portions of high explosive within less than 20 microsecond timescale more preferably within a less than 10 microsecond timescale, yet more preferably less than 5 microseconds so as to ensure that the detonation waves from adjacent portions of high explosive are able to combine and sustain detonation in the total cross sectional area of said portions of high explosive.

In order to provide a series of detonative pulses that are closely timed, a high voltage system such as, for example, a plurality of individual exploding foil initiators (EFI) or exploding bridgewires (EBW) may be used. Other forms of driven flyer plate may also be used, or laser initiation.

Lower specification munitions may not possess expensive high voltage systems, so in an alternative arrangement a single detonative pulse may be promulgated via a plurality of explosive track plates, detonation cords, or a detonation wave guide, so as to ensure that the single detonative pulse reaches all of the portions of high explosive substantially simultaneously. This degree of accuracy is vital so as to ensure that all of the portions of high explosive are detonated at substantially the same time, and hence sustained detonation is achieved in the total cross section of the portions of high explosive.

The warhead may be made up of a plurality of discrete portions of high explosive, which are enveloped by the non-detonative material. These enveloped portions of high explosives may be loaded into the munition individually or preassembled as a complete unit to provide the final warhead. According to a further aspect of the invention there is provided a method of preparing a warhead according to the invention, comprising the step of providing a plurality of portions of high explosive, each of which is below its critical detonation cross section, enveloping each portion in a non-detonative material, and arranging the portions to provide a total cross section of said portions which exceeds the critical detonation cross section of said high explosive.

In an alternative arrangement, especially for castable high explosive formulations, it may be desirable to preform a matrix or lattice of non-detonative material which can be filled with the melt or cure cast explosive, to form a ready contained portion of high explosive, such as to provide a warhead that comprises a plurality of voids formed by a lattice of intersecting walls of a non-detonative material, wherein each void has a cross section which is below the critical detonation cross section of a selected high explosive filling, such that upon filling said voids with said high explosive, provides a total cross section of said high explosive fillings which exceeds the critical detonation cross section of said high explosive. Accordingly there is provided a method of preparing a warhead according to the invention, comprising the step of providing a plurality of voids formed by a lattice of intersecting walls of a non-detonative material, wherein each void has a cross section which is below the critical detonation cross section of a selected high explosive filling, filling said voids with said high explosive, so as to provide a total cross section of said high explosive fillings that exceeds the critical detonation cross section of said high explosive.

The shape of the voids may be selected from any convenient shape, such as a described earlier for the at least two portions of high explosive. In addition more complex shapes may be prepared, as there is no requirement for arranging individual portions of high explosive. The shape of the void must permit the cross section of each void that contains a portion of high explosive to be less than the critical detonation cross section of said high explosive.

The matrix or lattice of non-detonative material may be located in the munition prior to filling with the castable explosive formulation, or it may be gently lowered into a munition that has just been filled with said castable formulation. Alternatively, the matrix of non-detonative material may be filled with said explosive and then inserted into a munition.

The warhead is designed such that simultaneous multi-point initiation of all the explosive elements at one end of the warhead leads to a propagating stable detonation. Although each portion of high explosive is below the critical detonation cross section, the interacting shock waves and dynamic confinement offered by the detonation of all the portions can be engineered to produce a stable detonation. Such engineering requires the layer of non-detonative material between the explosive charges to be selected so as to prevent the charges acting as one large charge and enable the interacting shock waves and dynamic confinement to support a stable detonation when all charges are initiated simultaneously. Ideally this non-detonative layer will be of a blast enhancing material which will react with the detonation products and ambient air to support and enhance the blast effects.

According to a further aspect of the invention there is provided a munition comprising at least one warhead according to the invention. Certain munitions have multiple warheads and it may be desirable that all warheads that are present are those according to the invention.

According to a further aspect of the invention there is provided a method of detonating a warhead by arranging at least two portions of high explosive separated by a non-detonative material, wherein each portion has a cross section below its critical detonation cross section, and wherein the at least two portions are arranged such that the total cross section of the at least two portions exceeds the critical detonation cross section of said high explosive, comprising the steps of supplying a detonative pulse to the at least two portions of high explosive substantially simultaneously.

According to a further aspect of the invention there is provided the use of a warhead according to the invention, in a munition, to reduce the risk of unwanted detonation.

According to a yet further aspect of the invention there is provided a kit of parts comprising a plurality of portions of high explosive, each of which is below its critical detonation cross section and separated by a non-detonative material, and a means of simultaneous detonation of the plurality of said portions of high explosive.

BRIEF DESCRIPTION OF THE DRAWINGS

Embodiments of the invention are described below by way of example only and with reference to the accompanying drawings in which.

DETAILED DESCRIPTION OF THE INVENTION

Figure 1:
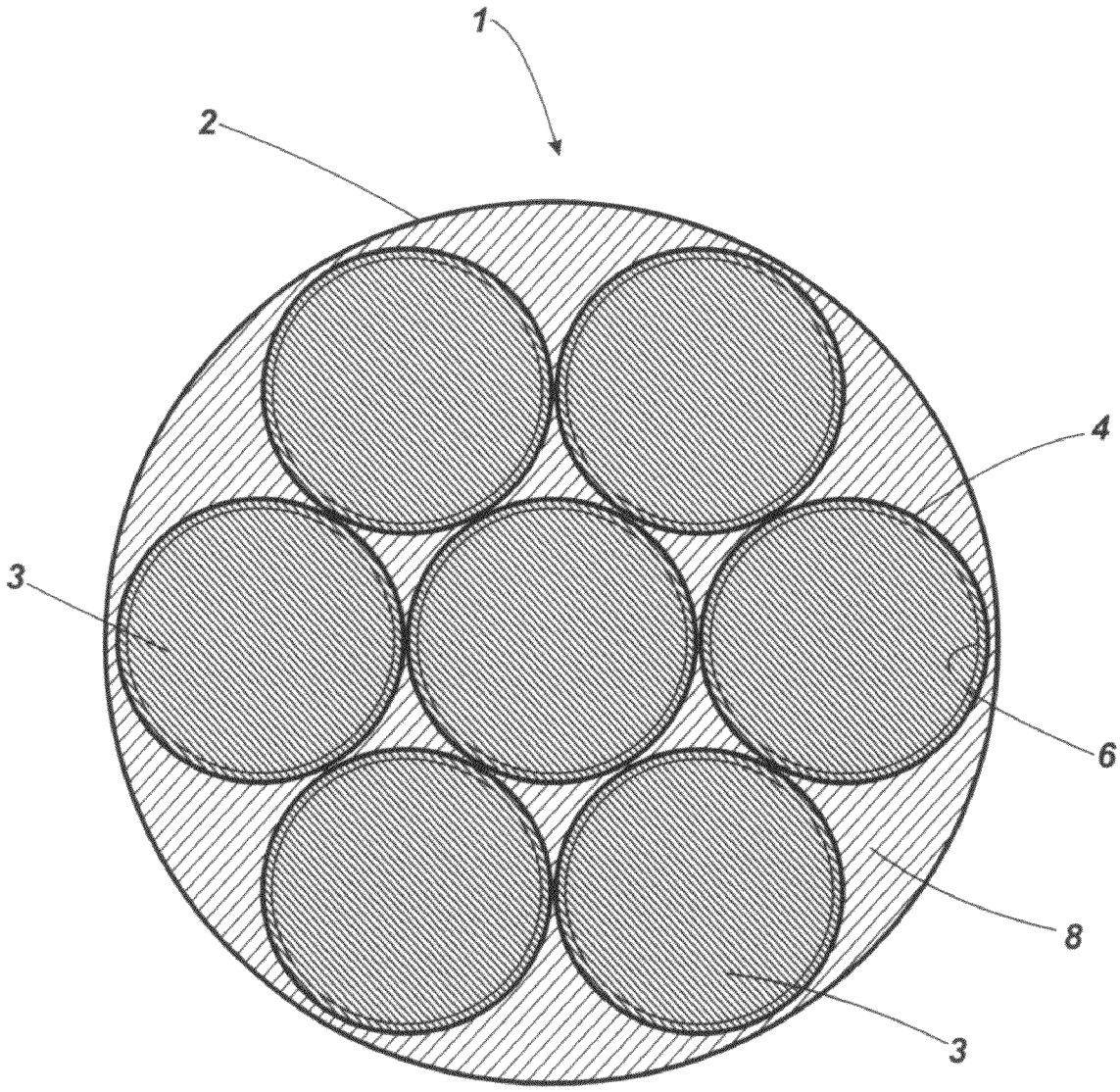
FIG. 1 shows a cross section of a cylindrical warhead in a munition casing of the invention.

FIG. 1, shows a top-down, cross sectioned view of munition 1 which possesses a case 2. Seven high explosive cylindrical charges 3 are arranged in a close packed arrangement, wherein respective outer edges 4 are separated by a non-detonative material 8, so that the charges 3 are not in intimate contact. In one embodiment of the manufacture, the melt cast explosive 3, may be poured into cardboard tubes 6 to create a cylindrical charge. The seven charges 3 may be held in place and the gaps between the charges are filled with non-detonative material 8.

Figure 2:
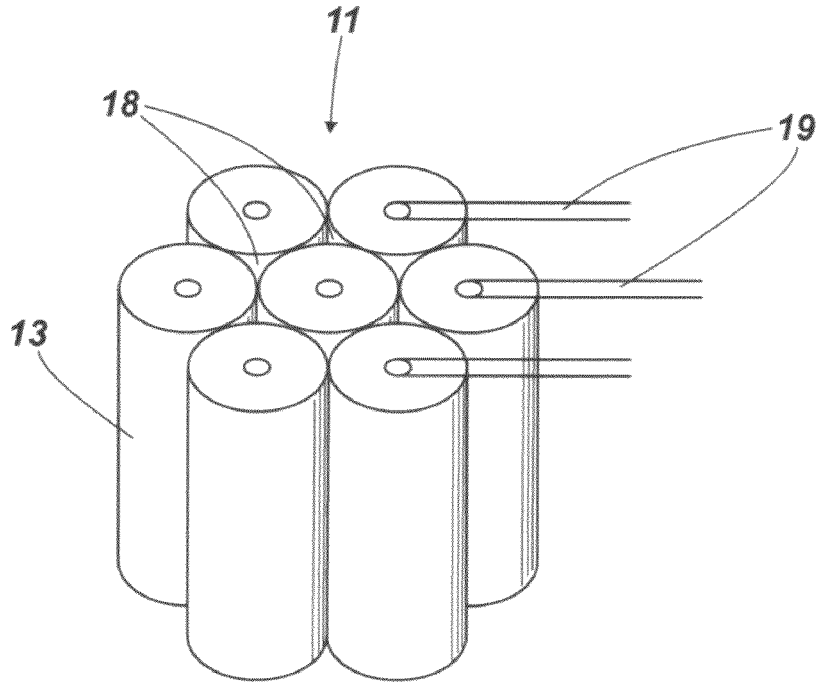
FIG. 2 shows a side elevation of a series of cylindrical charges for a warhead.

FIG. 2 shows a warhead charge 11 containing seven cylindrical charges 13 that are arranged in a closed packed arrangement. Between the abutting cylinders are a number of gaps 18 which may be filled with non-detonative material (not shown). On top of each charge 13, is located an initiator 19 configured to ensure substantially simultaneous detonation of each charge 13. The warhead charge 11 may then be inserted into a munition casing as shown in FIG. 1.

Figure 3:
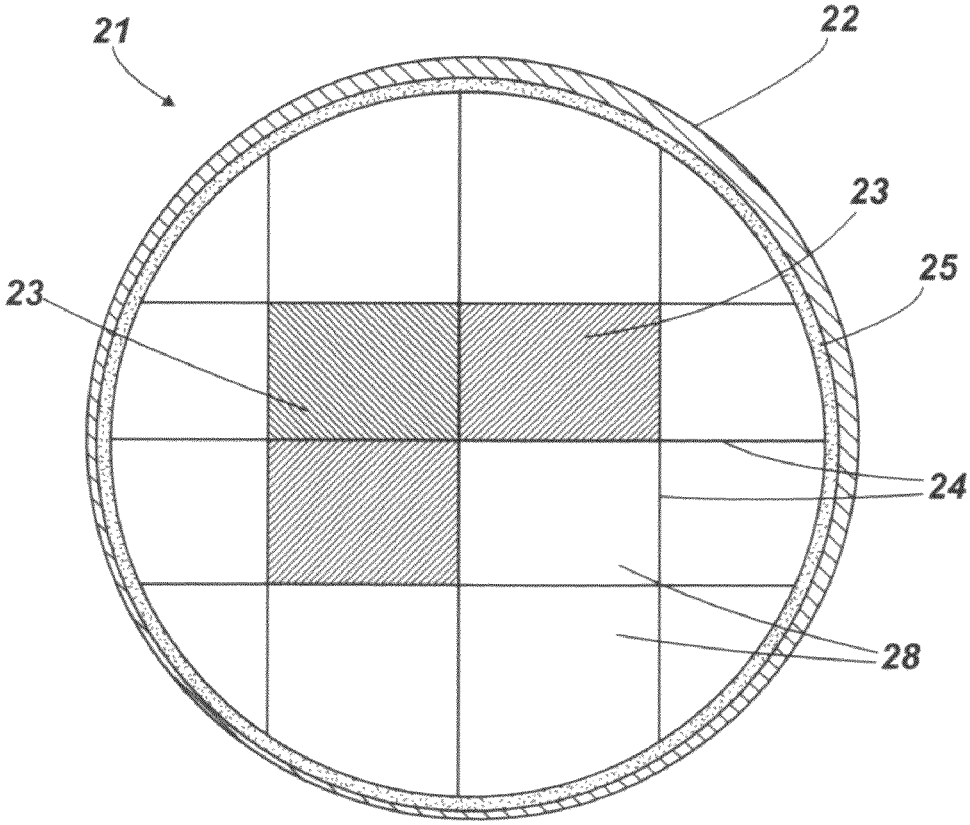
FIG. 3 shows a top view of a munition with predetermined voids ready for melt cast high explosives.

FIG. 3 shows a top view of a munition 21 which possess a case 22, having a lattice or matrix of non-detonative material walls 24 that define a plurality of voids 28. The voids 28 may then be filled with melt cast explosive 23. Conveniently, there may be a further band of non-detonative material 25 located between the outer periphery of the lattice/matrix 24 and the munition case 22.

Figure 4:
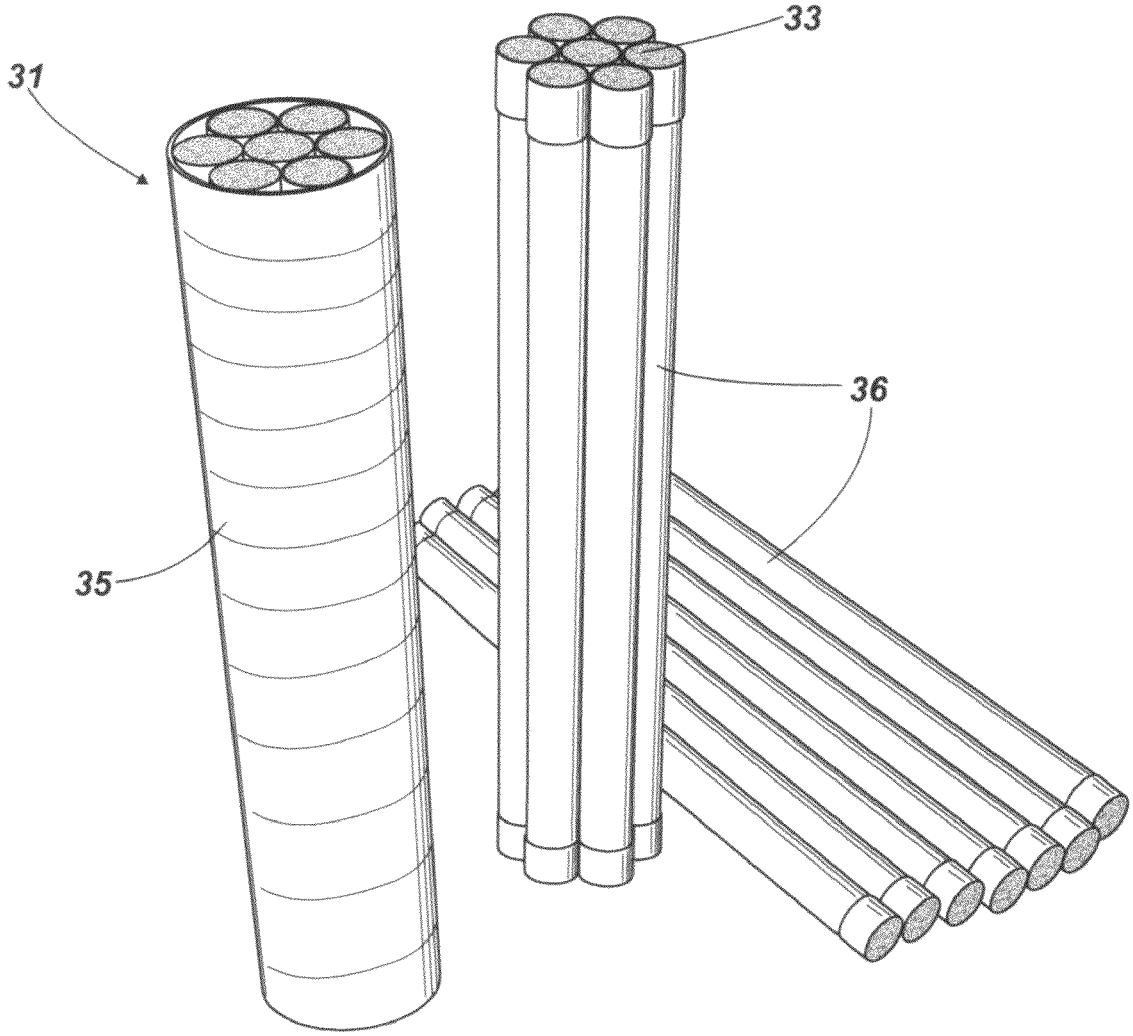
FIG. 4 shows a side view of a test charge being prepared.

FIG. 4 shows a side view of the sequence of the arrangement of a test warhead charge 31. Seven cardboard tubes 36 filled with high explosive composition 33 are arranged in a close packed configuration. The tubes 36 are held in place by a retaining band 35 (as an alternative to a munitions case).

Figure 5A:
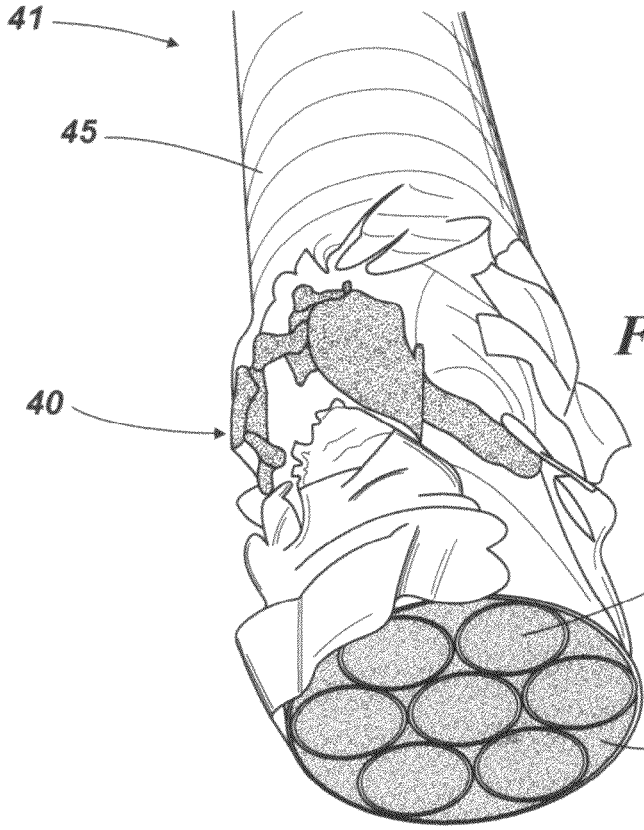
FIG. 5*a* shows an end view of a failed single point detonation test.
Figure 5B:
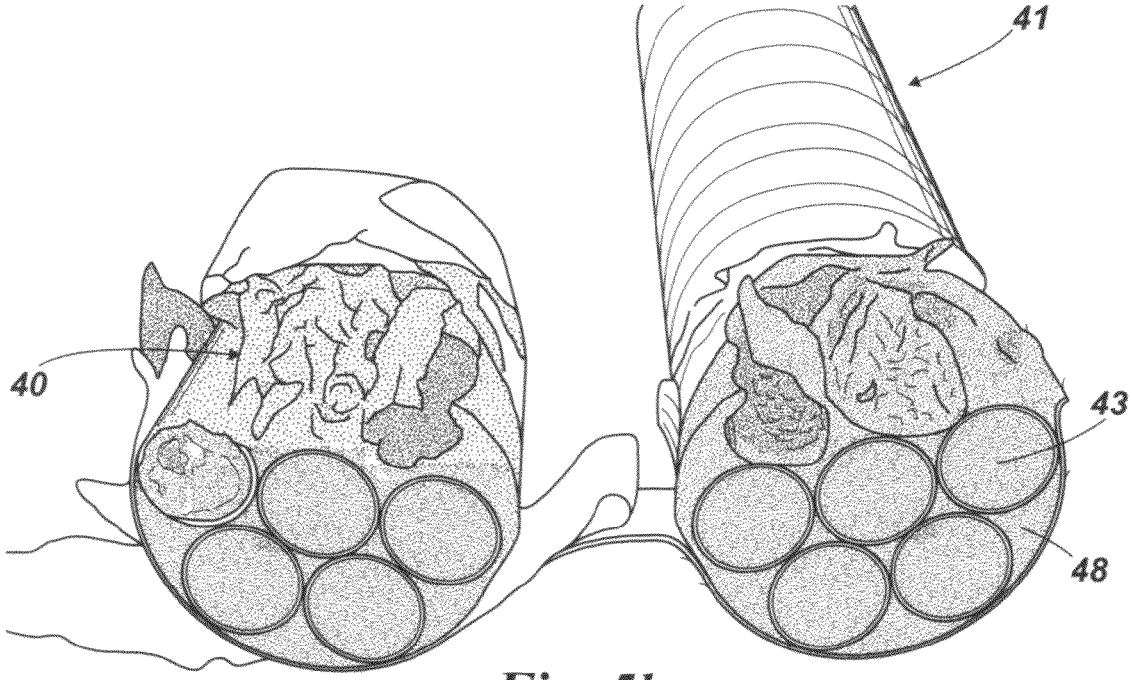
FIG. 5*b* shows the same charge after sectioning.

FIGS. 5*a* and 5*b* show end views of the test charge 41 after the single point detonation in experiment 3, described below. A pellet of high explosive (not shown) was located and detonated on the side of the charge 45, leading to damage 40 of the tube and the high explosive 43. As can bee seen in FIGS. 5*a* and 5*b* the test charge 41, is still largely intact, and did not result in an undesired detonation event.

Figure 6:
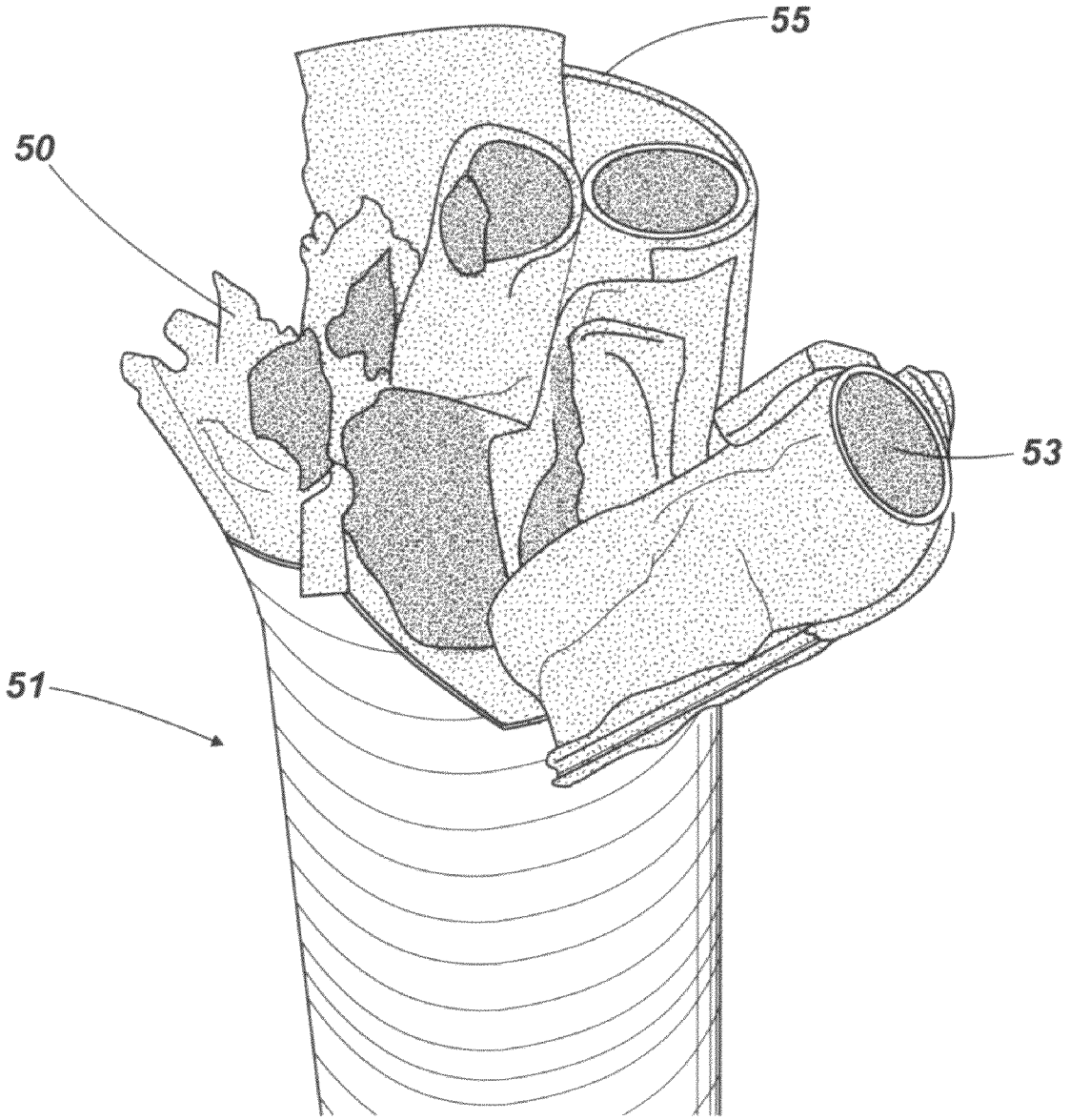
FIG. 6 shows a view of the damaged charge where the attempted initiation was at the end of the charge.

FIG. 6 shows a side elevation of a test charge 51 after the single point detonation in experiment 4, described below. A pellet of high explosive (not shown) was located and detonated on the top face of the charge 55, leading to damage 50 of the tube and the high explosive 53. As can be seen in FIG. 6, the test charge 51, is still largely intact, and did not result in an undesired detonation event.

Figure 7:
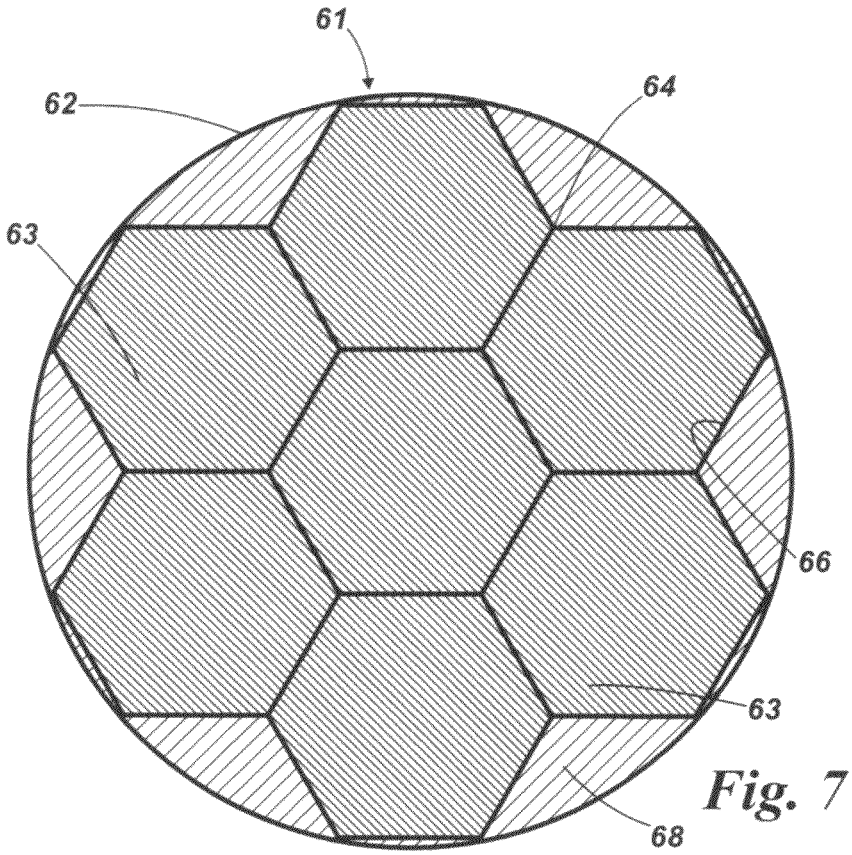
FIG. 7 shows a top view of an arrangement of hexagonal cross sectioned shaped explosive elements.

FIG. 7 shows a munition 61 which possesses a case 62. Seven high explosive hexagonal charges 63 are arranged in a close packed arrangement, their outer edges are separated by a non-detonative material 64. During the manufacture, the melt cast explosive 63, may be poured into cardboard tubes 66 to create a hexagonal charge, in a similar fashion as described in FIG. 1.

Figure 8:
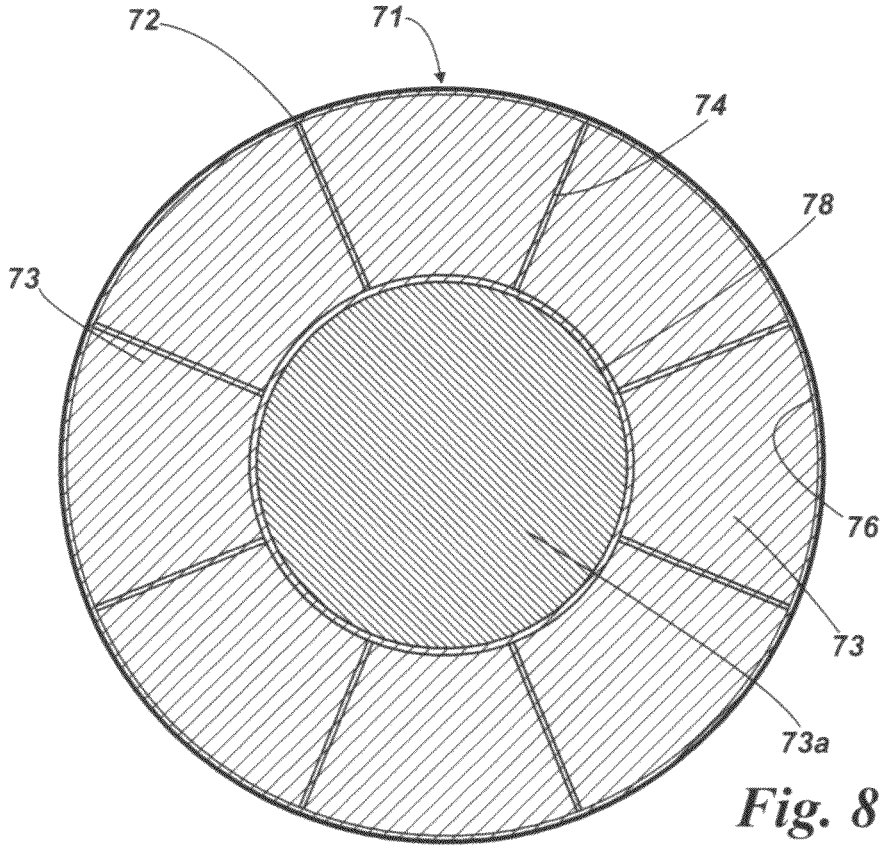
FIG. 8 shows a top view of a cake slice arrangement of substantially trapezoidal cross sectioned shaped explosive elements around a central core of high explosive.

FIG. 8 shows a munition 71 which possesses a case 72. Eight high explosive trapezoidal shaped charges 73 are arranged around a central core of high explosive 73*a* (which may be octagonal or circular). The edges 74, 76 and 78 are walls of non-detonative material.

Conveniently the edges 74, 76 and 78 are in the form of a lattice that creates the respective shaped voids which form portions of high explosive 73 and 73*a*. The charges may be held in place by filling any remaining voids with non-detonative material. The outer surface of 76 may be further coated in a non-detonative material (not shown) to provide additional protection from external hazards such as fragment or blast attacks.

Experiment 1

Critical Diameter Determination

For the purposes of a test model, an explosive was selected whose critical diameter was not less than ca. 10 mm, and whose critical diameter would not be larger than 20-25 mm. Composition QRX 104 (RDX 53%/Al 35%/HTPB-DOS-IPDI 12%) was selected. Thirteen 300 mm long test cylinders of this composition were manufactured with varying diameters to enable the critical diameter to be determined.

The charges were initiated at one end using a Debrix pellet (10 mm×10 mm) and EBW detonator. In all the tests, a steel witness plate was used to determine whether detonation propagated to the end of the charge. In addition 12 ionisation pins were used on 6 of the tests to provide detonation velocity information over the last 120 mm of the charge.

The results showed that the critical diameter for QRX 104 is between 15.5 and 18.9 mm, i.e. charges that had a diameter larger than 18.9 mm always detonated and charges less than 15.5 always failed. On this basis it was decided to fabricate the prototype warhead using 15.5 mm diameter cylinders of QRX 104.

Experiment 2

Simultaneous Initiation 4 prototype warheads were fabricated. These consisted of seven cylinders of QRX 104, each 15.5 mm in diameter and 300 mmm long, in thin cardboard tubes as for the critical diameter tests in Experiment 1. The seven charges were arranged in a close packed fashion inside a larger cardboard cylinder, to provide an arrangement similar to that in FIG. 1, (with the larger cardboard tube acting as a munition case). A small (2.2 mm) space was left between each charge and the surrounding space was completely filled with an inert non-detonative binder comprising HTPB/DOS/MDI (Hydroxyl Terminated Poly Butadiene, Di-Octyl Sebacate, Methylene Di-phenyl Di-isocyanate).

To test the design mode functioning of the prototype warhead, two tests were carried out in which the seven QRX 104 charges were simultaneously initiated at the top of the warhead using a purpose built polymethylmethacrylate (PMMA) track plate containing Primasheet, Debrix pellets (10 mm×10 mm) and 3 EBW detonators.

In these tests, the warhead charge was placed on an aluminium witness plate and 6 ionisation probes were placed around the bottom of the charge (adjacent to the 6 external charges) and one placed half way down at 150 mm. The result of the tests was full detonation of the charge with the witness plate holed and with all 6 probes at the base of the charge triggered virtually simultaneously. The detonation velocity was calculated at ca. 5.35 mm/μs.

Experiment 3

Single Point Initiation

To establish one-point safety, initiation of another identical prototype warhead, as prepared in experiment 2 was attempted by detonating a 10 mm×10 mm Debrix pellet in contact with the side of the warhead. The pellet was placed at a point of closest approach of one of the QRX 104 cylinders.

The test charge was placed on a witness plate and ionisation probes were deployed around the base of the charge. The witness plate, probes and recovered residue showed that the warhead failed to propagate to detonation, as seen in FIGS. 5*a* and 5*b*. The individual cylinders of explosive have too small a diameter and so will not sustain detonation. Furthermore, as the shock wave from the Debrix pellet only impinged on 1 or 2 of the cylinders of explosive, there was no simultaneous detonation of all of the cylinders, hence detonation could not be sustained.

Experiment 4

A further test of one-point safety was carried out on another identical prototype warhead, the same as Experiment 3, but in this test the 10 mm×10 mm Debrix pellet was placed in contact with the top of one of the QRX 104 cylinders. As for the previous test the warhead failed to detonate and the residue can be seen in FIG. 6. This shows that detonation of only one element of the high explosive, even from the end on position, still does not result in detonation of the complete charge. Therefore only simultaneous detonation of all elements i.e. portions of the high explosive charge will provide a sustained detonation reaction.

It is therefore possible to construct blast warheads which can be detonated in design mode by the use of multiple point initiation, but which are immune from detonation by single stimuli representative of hazards. This concept has the potential to provide a general IM solution for all medium to large blast or blast-fragmentation warheads, and as such should find wide application in the design of new warheads.

The study has demonstrated the viability of the concept by the design and testing of a small prototype warhead consisting of seven sub-critical diameter cylinders of a high explosive (based on RDX and aluminium) embedded in an inert binder matrix. Tests have shown that simultaneous initiation of the seven explosive components (using a track plate) led to full detonation of the warhead, whereas a single initiation on the side of the warhead led to a rapid failure to propagate.

The invention claimed is:

1. A warhead comprising at least two portions of high explosive separated by a non-detonative material, wherein each portion of high explosive has a cross section below its critical detonation cross section, and wherein the at least two portions of high explosive are arranged such that the total cross section of the at least two portions of high explosive exceeds the critical detonation cross section of said high explosive, such that in use only simultaneous detonation of the at least two portions of high explosive causes detonation to occur.

2. A warhead according to claim 1, wherein there are three or more portions of high explosive, each of which is below its critical detonation cross section.

3. A warhead according to claim 1, wherein there are between 2 and 20 portions of high explosive, each of which is below its critical detonation cross section.

4. A warhead according to claim 1, wherein each portion of high explosive is substantially cylindrical, and each cylinder has a diameter which is below its critical detonation diameter.

5. A warhead according to claim 1 wherein a further portion of non-detonative material is enveloped around the total cross section of the at least two portions, so as to provide a further barrier to unwanted detonation.

6. A warhead according to claim 1, wherein the non-detonative material is an energetic material not capable of sustaining detonation.

7. A warhead according to claim 6, wherein the non-detonative material is an energetic binder.

8. A warhead according to claim 1 wherein the warhead comprises a plurality of voids formed by a lattice of intersecting walls of a non-detonative material, wherein each void has a cross section which is below the critical detonation cross section of a selected high explosive filling, such that upon filling said voids with said high explosive, provides a total cross section of said high explosive fillings which exceeds the critical detonation cross section of said high explosive.

9. A warhead according to claim 1, wherein the at least two portions of high explosive are arranged such that each portion is co-located along its longest axis or are co-axially arranged.

10. A method of detonating a warhead comprising at least two portions of high explosive separated by a non-detonative material, wherein each portion of high explosive has a cross section below its critical detonation cross section, and wherein the at least two portions of high explosive are arranged such that the total cross section of the at least two portions of high explosive exceeds the critical detonation cross section of said high explosive, such that in use only simultaneous detonation of the at least two portions of high explosive causes detonation to occur, the method comprising the step of supplying a detonative pulse to each portion of high explosive substantially simultaneously.

11. A method according to claim 10, wherein each detonative pulse is provided by an individual EFI, EBW, laser pulse or driven flyer.

12. A method according to claim 10, wherein a single detonative pulse is promulgated via one or more track plates, or a detonation wave-guide to provide a detonative pulse to each portion of high explosive.

13. A method of preparing a warhead comprising at least two portions of high explosive separated by a non-detonative material, wherein each portion of high explosive has a cross section below its critical detonation cross section, and wherein the at least two portions of high explosive are arranged such that the total cross section of the at least two portions of high explosive exceeds the critical detonation cross section of said high explosive, such that in use only simultaneous detonation of the at least two portions of high explosive causes detonation to occur, the method comprising the step of providing a plurality of portions of high explosive, each of which is below its critical detonation cross section, enveloping each portion in a non-detonative material, and arranging the portions to provide a total cross section of said portions which exceeds the critical detonation cross section of said high explosive.

14. A method of preparing a warhead comprising at least two portions of high explosive separated by a non-detonative material, wherein each portion of high explosive has a cross section below its critical detonation cross section, and wherein the at least two portions of high explosive are arranged such that the total cross section of the at least two portions of high explosive exceeds the critical detonation cross section of said high explosive, such that in use only simultaneous detonation of the at least two portions of high explosive causes detonation to occur, the method comprising the step of providing a plurality of voids formed by a lattice of intersecting walls of a non-detonative material, wherein each void has a cross section which is below the critical detonation cross section of a selected high explosive filling, filling said voids with said high explosive, so as to provide a total cross section of said high explosive fillings exceeds the critical detonation cross section of said high explosive.

* * * * *